US009499007B1

(12) United States Patent
Whaley et al.

(10) Patent No.: US 9,499,007 B1
(45) Date of Patent: Nov. 22, 2016

(54) GEAR OPERATED RING BINDER

(71) Applicant: U.S. Ring Binder, L.P., St. Louis, MO (US)

(72) Inventors: Paul Whaley, Herculaneum, MO (US); Chang Yuan Xu, St. Louis (CN)

(73) Assignee: U.S. Ring Binder, L.P., St. Louis, MO (US)

( * ) Notice: Subject to any disclaimer, the term of this patent is extended or adjusted under 35 U.S.C. 154(b) by 0 days.

(21) Appl. No.: 15/143,777

(22) Filed: May 2, 2016

Related U.S. Application Data

(60) Provisional application No. 62/295,800, filed on Feb. 16, 2016.

(51) Int. Cl.

| | |
|---|---|
| ***B42F 13/16*** | (2006.01) |
| ***B42F 13/20*** | (2006.01) |
| ***B42F 13/22*** | (2006.01) |
| ***B42F 13/26*** | (2006.01) |

(52) U.S. Cl.
CPC ..... *B42F 13/26* (2013.01); *B42F 13/16* (2013.01); *B42F 13/20* (2013.01); *B42F 13/22* (2013.01)

(58) Field of Classification Search
CPC ..... B42F 13/16–13/26
USPC ..... 402/38, 41
See application file for complete search history.

(56) References Cited

U.S. PATENT DOCUMENTS

| | | | | |
|---|---|---|---|---|
| 4,798,491 | A | 1/1989 | Lässle | |
| 9,102,188 | B2 | 8/2015 | Wong | |
| 2008/0095572 | A1 | 4/2008 | Frankeny | |
| 2010/0150642 | A1 | 6/2010 | Lee | |
| 2014/0205361 | A1* | 7/2014 | Warmus | B42F 13/26 402/41 |

* cited by examiner

*Primary Examiner* — Kyle Grabowski
(74) *Attorney, Agent, or Firm* — Polster, Lieder, Woodruff & Lucchesi, L.C.

(57) ABSTRACT

A binder ring metal (10) includes binder rings (12-16) portions of which are installed on frame assemblies (18*a*, 18*b*) installed in a side-by-side relationship within a shield (20). A lever (22) is operatively connected with a travel bar (24) for movement of the lever to effect opening or closing of the rings. A gear mechanism (G) includes a plurality of gear teeth (30) are formed on lever, and a plurality of gear teeth (32) are formed on an adjacent surface of the travel bar. These teeth mesh with each other so movement of the lever by a user effects movement of the travel bar to respectively unblock or block movement of the frame assemblies, so the binder ring can open or close.

7 Claims, 9 Drawing Sheets

GEAR OPERATED RING BINDER

CROSS REFERENCE TO RELATED APPLICATIONS

This application is based upon and claims the benefit of U.S. Provisional Patent Application 62/295,800 filed Feb. 16, 2016.

STATEMENT REGARDING FEDERALLY SPONSORED RESEARCH OR DEVELOPMENT

N/A

BACKGROUND OF THE INVENTION

This invention relates to ring binders for storing loose leaf sheets of paper and the like and more particularly to a ring metal for the binder which employs a gear mechanism to open and close the metal.

Conventional locking metals; i.e., those which provide a "positive" lock when the binder rings of the metal are closed include some type of travel bar connected to a lever mounted at one end of the metal either through a spring or an equivalent of a spring. In these ring metal designs, a "lost motion" feature is incorporated so movements to open and close the binder rings occur in a desired sequence.

While these binders generally work well for their intended purpose, if a spring breaks, or part of the mechanism incorporating the spring is damaged or fails, the ring metal is rendered inoperative.

The present invention avoids the possibility of these problems or failures occurring.

BRIEF SUMMARY OF THE INVENTION

The present invention is directed to a binder ring metal employing a gear mechanism including a set of gears to move a travel bar to open and close binder rings and lock the rings in their closed position. The gear set includes gear teeth formed on a lever installed at one end of the ring metal and operated by a user of the binder to open and close the rings. The gear set further includes gears formed on the travel bar which mesh with the teeth on the lever.

The respective gear teeth are integrally formed with the respective lever and travel bar and tightly mesh together so to provide a smooth opening and closing of the rings.

Both the lever and travel bar can be formed of a light-weight but sturdy metal or plastic material.

Other objects and features will be in part apparent and part pointed out hereinafter.

BRIEF DESCRIPTION OF THE SEVERAL VIEWS OF THE DRAWINGS

The accompanying figures, together with detailed description which follows, form part of the specification and illustrate the various embodiments described in the specification.

Corresponding reference characters indicate corresponding parts throughout the several views of the drawings.

DETAILED DESCRIPTION OF INVENTION

Figure 1A:
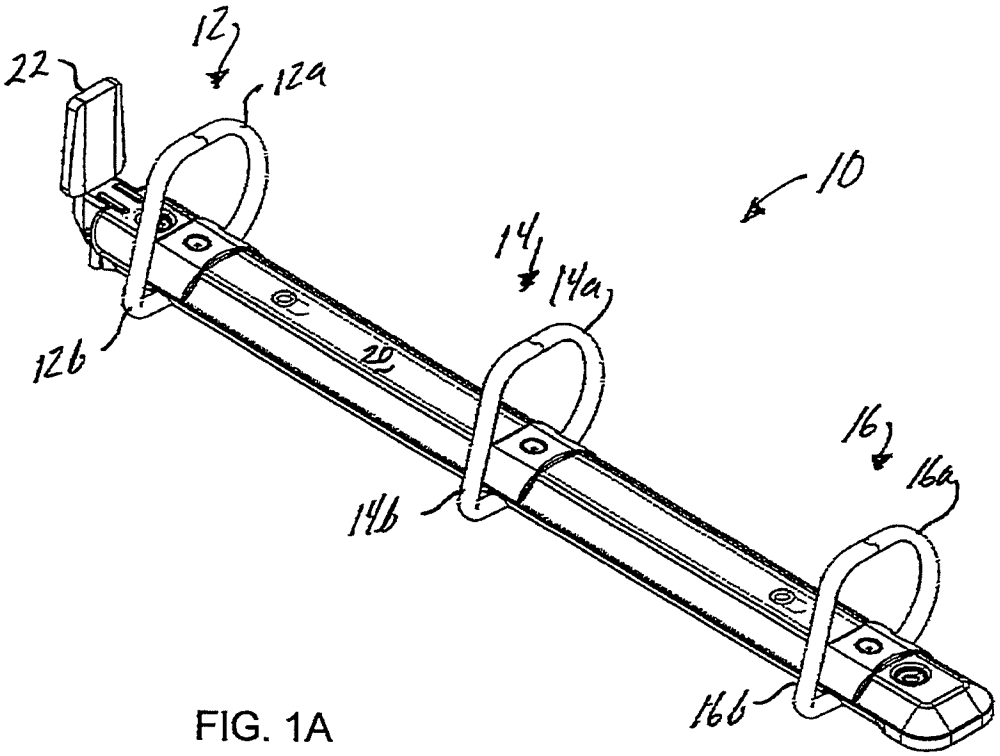
FIG. 1A is a perspective of a gear operated ring metal of the present invention with binder rings of the metal closed.
Figure 1B:
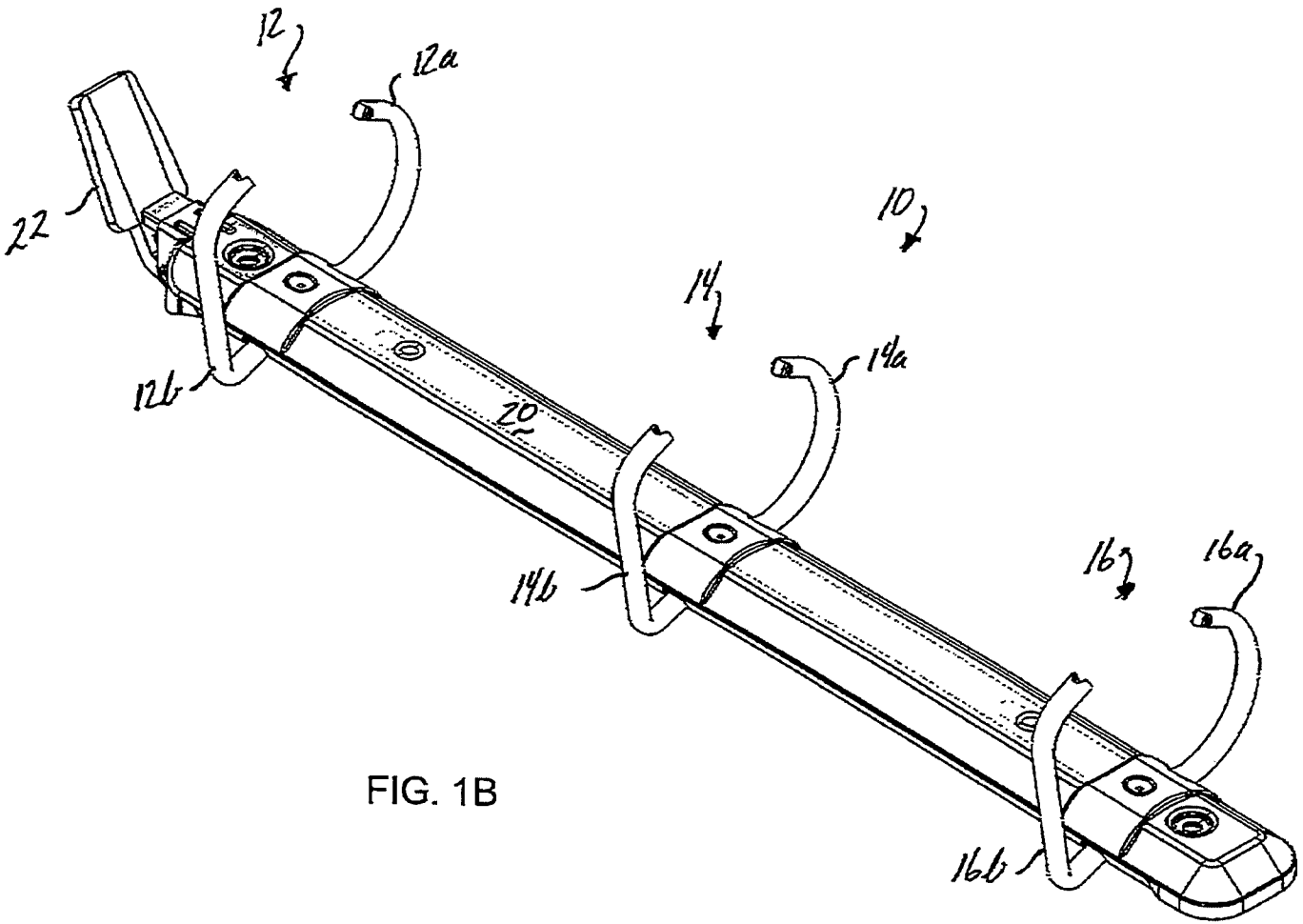
FIG. 1B is a similar view with the rings open.

The following detailed description illustrates the invention by way of example and not by way of limitation. This description clearly enables one skilled in the art to make and use the invention, and describes several embodiments, adaptations, variations, alternatives and uses of the invention, including what is presently believed to be the best mode of carrying out the invention. Additionally, it is to be understood that the invention is not limited in its application to the details of construction and the arrangement of components set forth in the following description or illustrated in the drawings. The invention is capable of other embodiments and of being practiced or carried out in various ways. Also, it will be understood that the phraseology and terminology used herein is for the purpose of description and should not be regarded as limiting.

Referring to the drawings, a ring metal 10 for a binder (not shown) includes a plurality of binder rings 12, 14, 16, each comprising a pair of mating ring segments (12*a*-12*b*, 14*a*-14*b*, and 16*a*-16*b*) when the rings are closed. In the drawings, the binder rings illustrated are what is commonly referred to in the art as "D" rings. However, those skilled in the art will understand that other types of binder rings; e.g., round or oval shaped rings may be used without departing from the scope of the invention.

Figure 2:
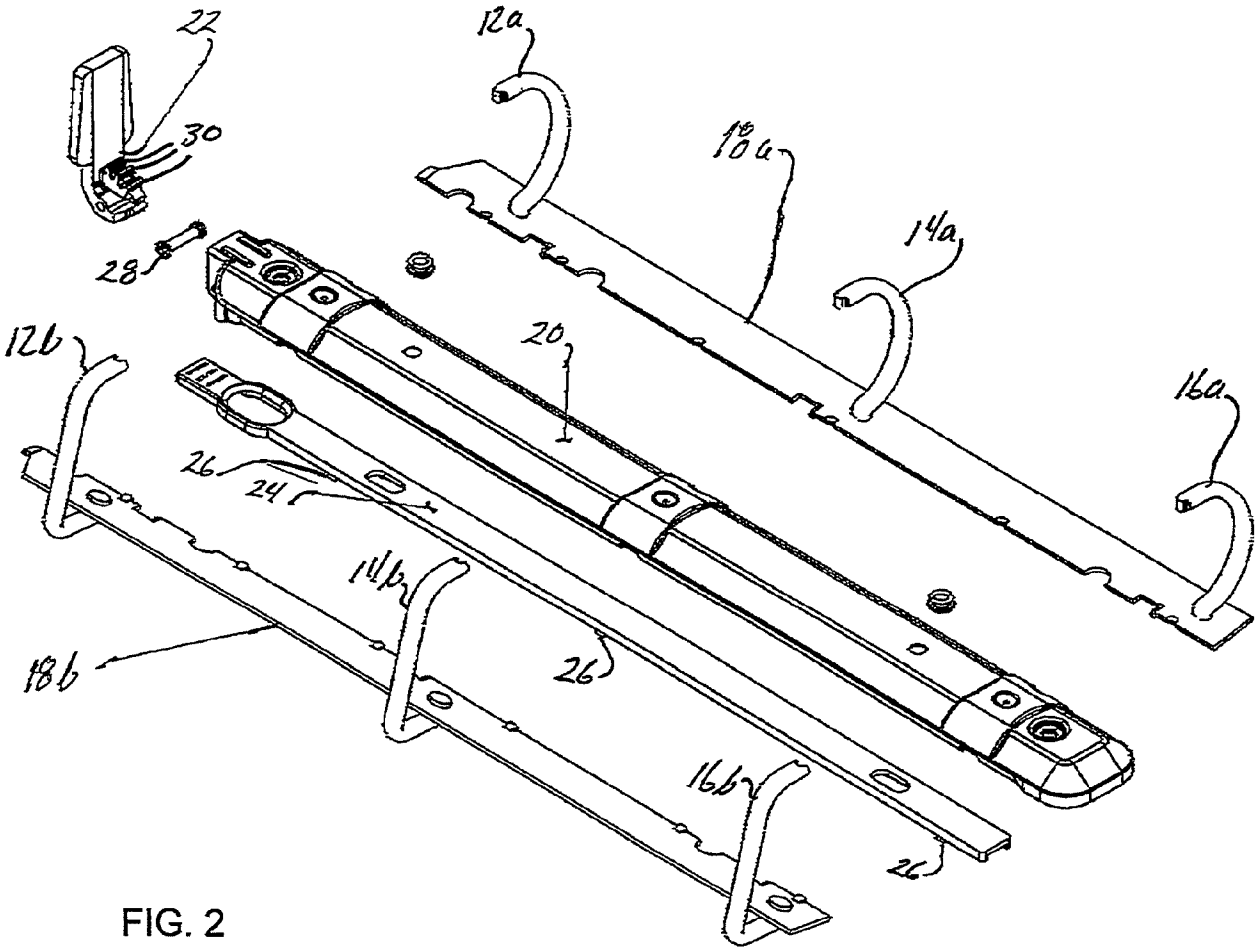
FIG. 2 is an exploded view of the ring metal.
Figure 3A:
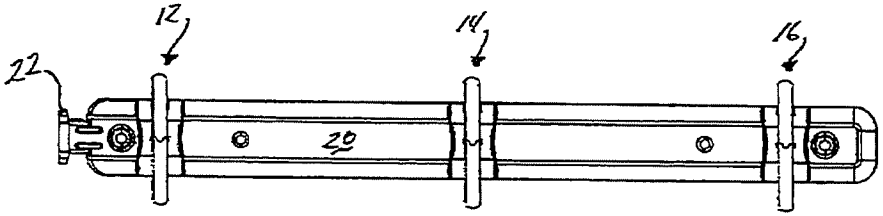
FIGS. 3A-3D are respective top, bottom, side, and end views of the ring metal.
Figure 3B:
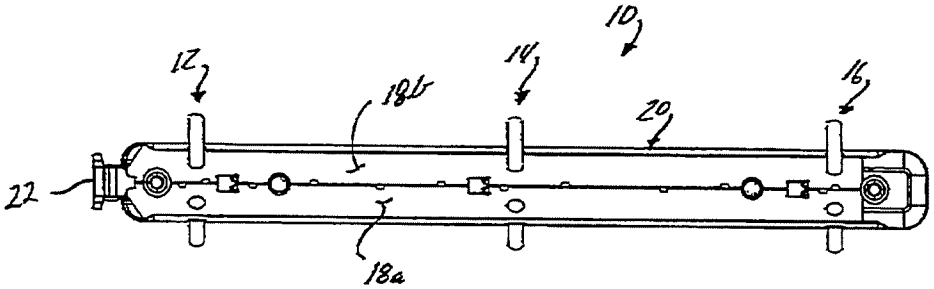
Figure 3C:
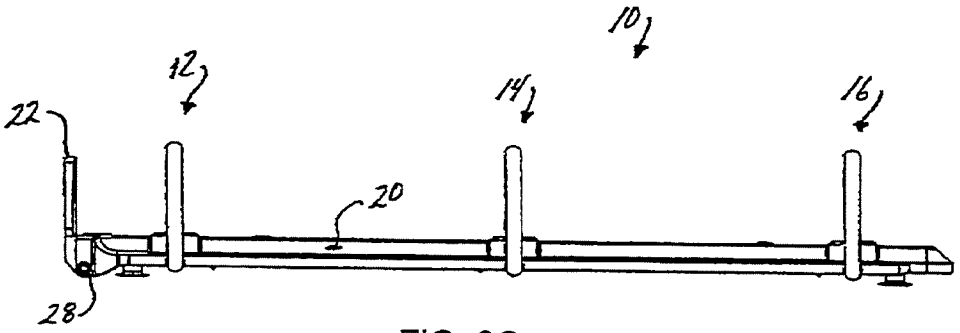
Figure 3D:
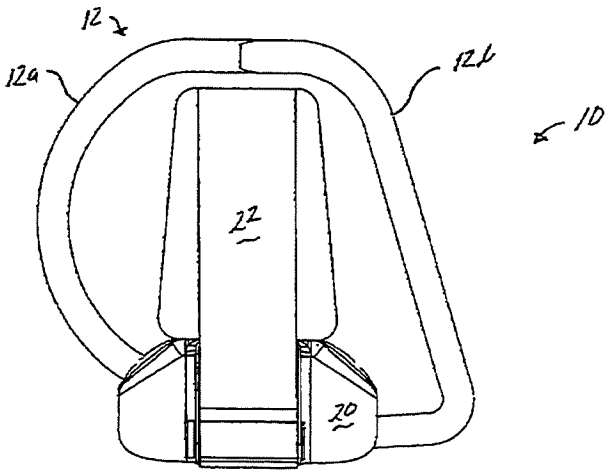
Figure 4:
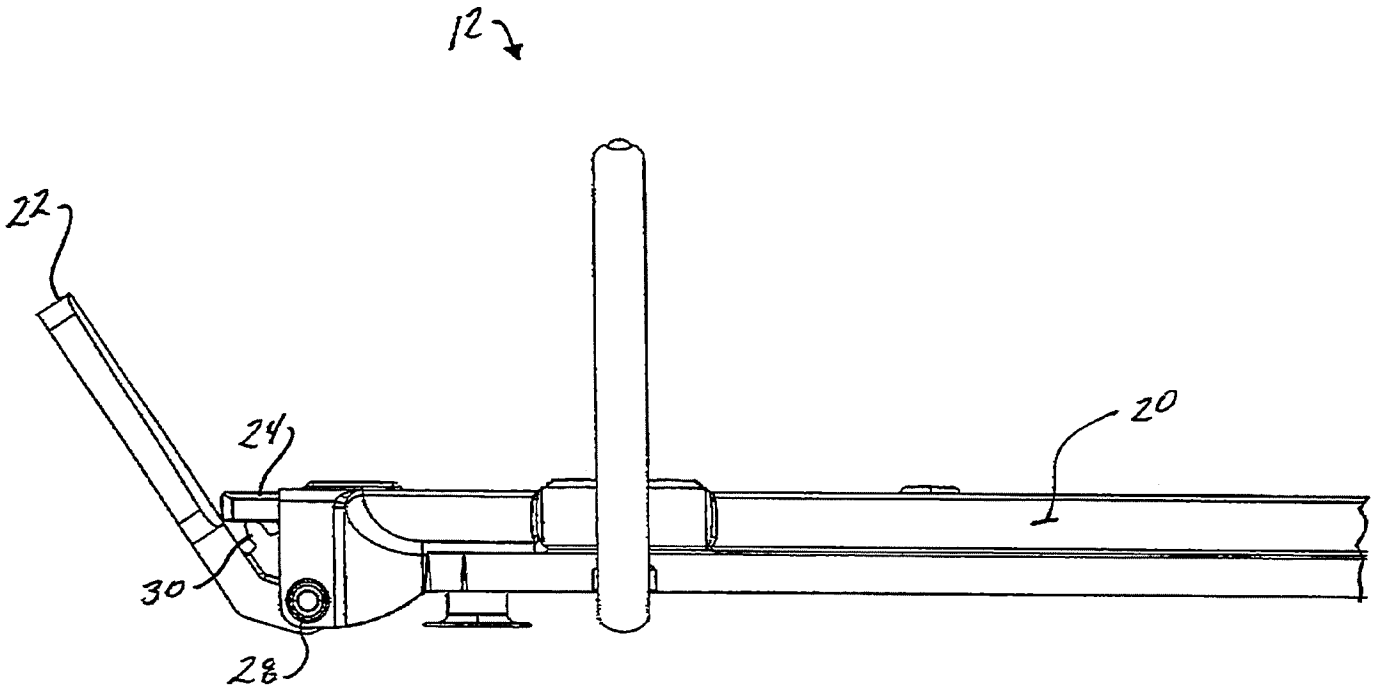
FIG. 4 is an elevation view of the lever end of the ring metal illustrating the gear mechanism of the present invention.

As shown in FIG. 2, the respective ring segments are integrally formed, in a spaced relationship, on respective frame assemblies 18*a*, 18*b*. The frame assemblies are installed on the underside of a shield 20 in a side-by-side relationship within the shield for movement of the assemblies to open and close the binder ring.

A lever 22, installed at one end of the ring metal cooperates with a travel bar 24 that extends the length of the ring metal, to effect opening and closing of the rings. As is known in the art, travel bar 24 includes blocking elements 26 that effectively locks rings 12-16 in their closed position when the binder is closed. When lever 22 is moved to open the rings, it moves travel bar 24 in a direction to move blocking elements 26 out of the way so that the rings can open. Operation of the travel bar in this regard is not described.

Lever 22 is generally L-shaped having a vertical portion which a user can move backward or forward using a finger or thumb, so to pivot the lever about a pin 28 used to attach the lever to shield 20.

Figure 5:
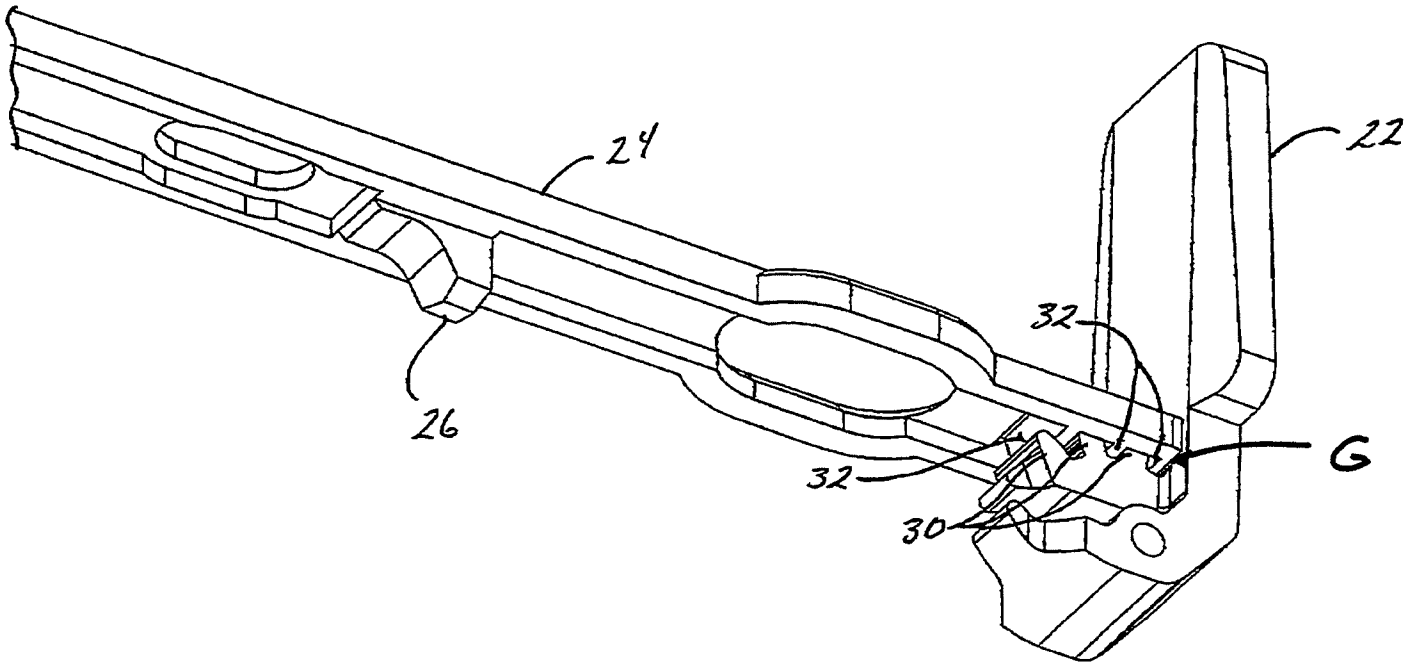
FIG. 5 is a perspective view of the underside of the ring metal illustrating the gear mechanism.

A gear mechanism indicated generally G in the drawings (see FIGS. 5-7) is co-operatively formed on the lever and travel bar. Gear mechanism includes a set of teeth including a plurality of gear teeth 30 formed along the upper reach of the horizontally extending portion of the lever. While three such teeth 30 are shown in the drawings, those skilled in the art will appreciate there may be more or fewer teeth 30. Next, a series of meshing gear teeth 32 are formed on an adjacent surface of the travel which, as shown in the drawings, is the underside of travel bar 24 at the end of the travel bar adjacent lever 22. As particularly shown in FIG. 7, there are three such teeth 32. Again, those skilled in the art will appreciate there may be more or fewer teeth 32.

As shown in the drawings, the gear teeth 30 are integrally formed on lever 22 and the gear teeth 34 are integrally formed with travel bar 24. The gear teeth tightly mesh with each other so that there is no "looseness" between the lever and travel bar that would otherwise result in a "lost motion" when lever 22 is operated to open or close the binder rings. This insures smooth operation of the ring metal both in opening, and in closing and locking the binder rings 12-16.

Figure 6:
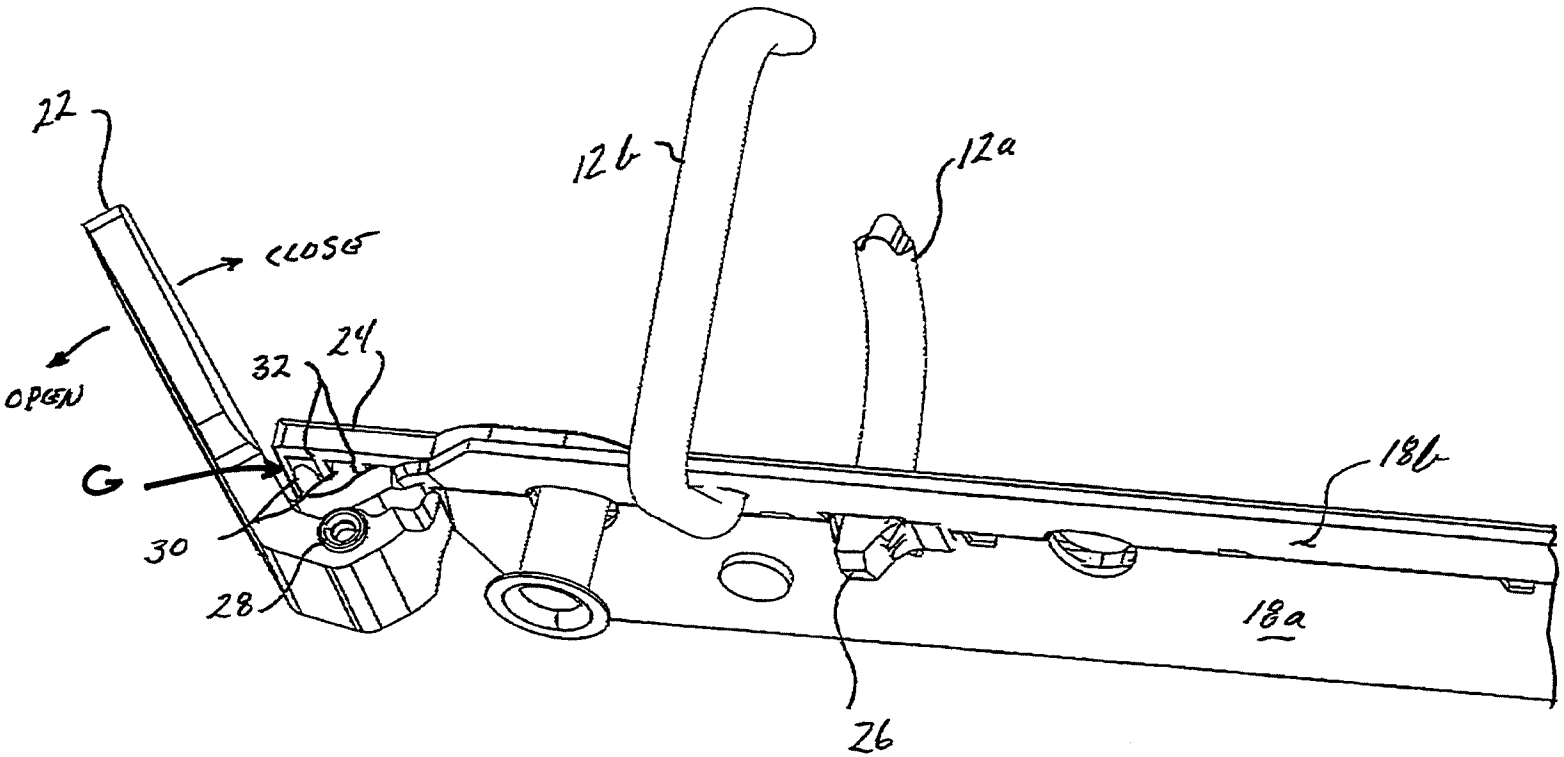
FIG. 6 is a view similar to FIG. 5 but with the frames of the metal installed; and, FIG. 7 is a perspective view of the lever end portion of the metal illustrating the gear mechanism.
Figure 7:
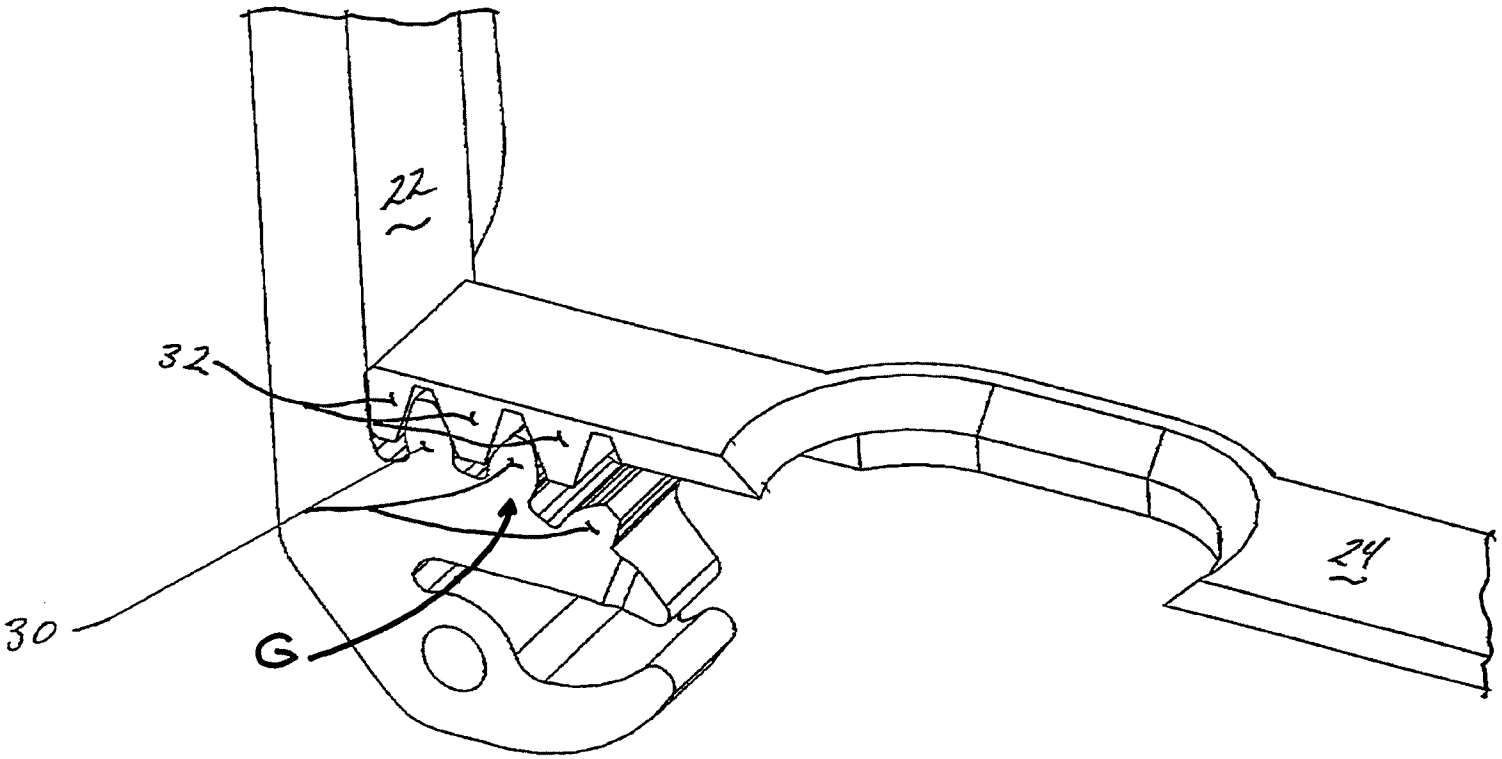

Referring to FIG. 6, when the binder is to be opened, a user moves lever 22 counterclockwise (as viewed in the Fig.). The teeth 30 on the lever accordingly also move counterclockwise and the meshing arrangement of gear teeth 30 and 32 draw travel bar 24 to the left (again, as viewed in the Fig.). This movement of the travel bar withdraws blocking elements 26 out of their blocking position, allowing frame assemblies 18*a*, 18*b* to rotate in opposite directions opening the binder rings 12-16.

Still referring to FIG. 6, when the binder is to be closed, a user moves lever 22 clockwise (as viewed in the Fig.). The teeth 30 on the lever now move clockwise and the meshing arrangement of gear teeth 30 and 32 push travel bar 24 to the right (again, as viewed in the Fig.). This movement of the travel bar now further moves blocking elements 26 back into their blocking position, locking the binder rings 12-16 in their closed position when the rings close.

In view of the above, it will be seen that the several objects and advantages of the present disclosure have been achieved and other advantageous results have been obtained.

Having thus described the invention, what is claimed and desired to be secured by Letters Patent is:

1. In a binder ring metal having at least one binder ring, the binder ring having complementary ring halves formed on respective frame assemblies, the frame assemblies being installed in a side-by-side relationship within a shield for movement of the assemblies to open and close the binder ring, a lever mounted at one end of the shield for movement by a user to effect movement of the assemblies, and a travel bar directly contacted by the lever, the travel bar being generally within a single plane throughout its length and movable by the lever for locking the binder ring when the binder ring is in the closed position, an improvement comprising:

a gear mechanism co-operatively formed on the lever and travel bar so that movement of the lever by a user to open and close the binder ring effects a corresponding simultaneous movement of the travel bar to respectively unblock or block movement of the frame assemblies without any lost motion or delay in the movement, so the binder ring can open or close.

2. The improvement of claim 1 in which the gear mechanism includes a set of meshing gear teeth a portion of which are formed on a portion of the lever, and a portion of which are formed on an adjacent surface of the travel bar.

3. The improvement of claim 2 in which the set of gear teeth includes plurality of gear teeth formed on one surface of the lever, and a plurality of gear teeth formed on the adjacent surface of the travel bar, the respective gear teeth meshing with each other so that movement of the lever by a user to open and close the binder ring effects a corresponding movement of the travel bar to respectively unblock or block movement of the frame assemblies, so the binder ring can open or close.

4. The improvement of claim 3 in which respective teeth of the set of gear teeth are integrally formed on the lever and integrally formed on the travel bar.

5. The improvement of claim 3 in which teeth of the set of gear teeth formed on the lever tightly mesh with teeth of the set of gear teeth formed on the travel bar so there is no lost motion between the movement of the lever by a user and a consequential movement of the travel bar.

6. The improvement of claim 3 in which the lever and travel bar are formed of a lightweight metal or plastic material.

7. The improvement of claim 1 in which the binder ring metal includes a plurality of binder rings each of which has complementary ring halves formed on the respective frame assemblies for movement of the assemblies to open and close the binder rings.

* * * * *